US006148957A

United States Patent [19]

Ahl et al.

[11] Patent Number: 6,148,957

[45] **Date of Patent: *Nov. 21, 2000**

[54] LADDER SUPPORTED SCAFFOLDING

[76] Inventors: Frank E. Ahl, P.O. Box 41; Brian E. Ahl, P.O. Box 154, both of Elliston, Mont. 59728

[ * ] Notice: This patent issued on a continued prosecution application filed under 37 CFR 1.53(d), and is subject to the twenty year patent term provisions of 35 U.S.C. 154(a)(2).

[21] Appl. No.: 08/819,720

[22] Filed: Mar. 17, 1997

[51] Int. Cl.[7] ..... E06C 7/16

[52] U.S. Cl. ..... 182/117; 182/121

[58] Field of Search ..... 182/117, 118, 182/115, 121, 122

[56] References Cited

U.S. PATENT DOCUMENTS

| | | | |
|---|---|---|---|
| 362,747 | 5/1887 | Higgins . | |
| 393,512 | 11/1888 | Long . | |
| 400,008 | 3/1889 | Rasor . | |
| 524,270 | 8/1894 | Wimbush . | |
| 652,010 | 6/1900 | Wheeler . | |
| 689,390 | 12/1901 | Ewing . | |
| 711,384 | 10/1902 | Carman . | |
| 881,996 | 3/1908 | Block . | |
| 1,008,827 | 11/1911 | Hutchinson . | |
| 1,112,511 | 10/1914 | Winn | 182/121 |
| 1,187,437 | 6/1916 | Lucas . | |
| 1,228,868 | 6/1917 | Anderson . | |
| 1,487,243 | 3/1924 | Jackson . | |
| 1,501,298 | 7/1924 | Armitage | 182/117 |
| 1,718,885 | 6/1929 | Williams | 182/121 |
| 2,418,597 | 4/1947 | Neff . | |
| 2,430,642 | 11/1947 | Mahattey . | |
| 2,557,270 | 6/1951 | Franklin et al. . | |
| 2,818,310 | 12/1957 | Campbell . | |
| 2,827,336 | 3/1958 | Johnson . | |
| 2,856,112 | 10/1958 | Broderick . | |
| 2,910,135 | 10/1959 | Moore . | |
| 2,936,989 | 5/1960 | Siek . | |
| 3,185,425 | 5/1965 | Lane . | |
| 3,340,960 | 9/1967 | Wilson | 182/117 |
| 3,491,852 | 1/1970 | Leist . | |
| 3,899,045 | 8/1975 | Geisel et al. . | |
| 4,232,759 | 11/1980 | Jacobs . | |

(List continued on next page.)

*Primary Examiner*—Alvin Chin-Shue
*Attorney, Agent, or Firm*—Jerry Johnson

[57] ABSTRACT

The ladder scaffold assembly of the present invention for releasable mounting on two spaced apart ladders placed side by side comprises a scaffold platform having opposing first and second lateral ends and a ladder attachment bracket disposed on the opposing ends of the platform for supporting the platform in an elevated horizontal position intermediate two spaced apart ladders. Step engagement means are disposed on each ladder attachment bracket, wherein the step engagement means comprise an upward sloping surface to releasably engage and securely hook onto a step from underneath the step. The step engagement means is rigidly attached to the ladder attachment bracket and is incapable of independent movement in relation to the platform. The upward sloping surface permits releasable engagement to a step that may comprise a step of a step ladder or adjacent side by side rungs of an extension ladder. The ladder scaffold assembly may additionally comprise step contact means disposed on the ladder attachment bracket to permit temporary contact to a second step of a ladder located above the first step. The step contact means permits temporary contact with a second step that may comprise a step of a step ladder or rung of an extension ladder. The inclusion of the step contact means in the ladder attachment bracket allows for releasable mounting of the ladder scaffold on two spaced apart ladders placed side by side in an additional situation wherein the step engagement means releasably engage a single rung of an extension ladder. The step contact means are also rigidly attached to the ladder attachment brackets and are incapable of independent movement in relation to the platform. The ladder attachment brackets may be independent and separable from the scaffold platform. Or, the ladder attachment brackets may be integrally formed with the scaffold platform.

8 Claims, 9 Drawing Sheets

Figure 1:
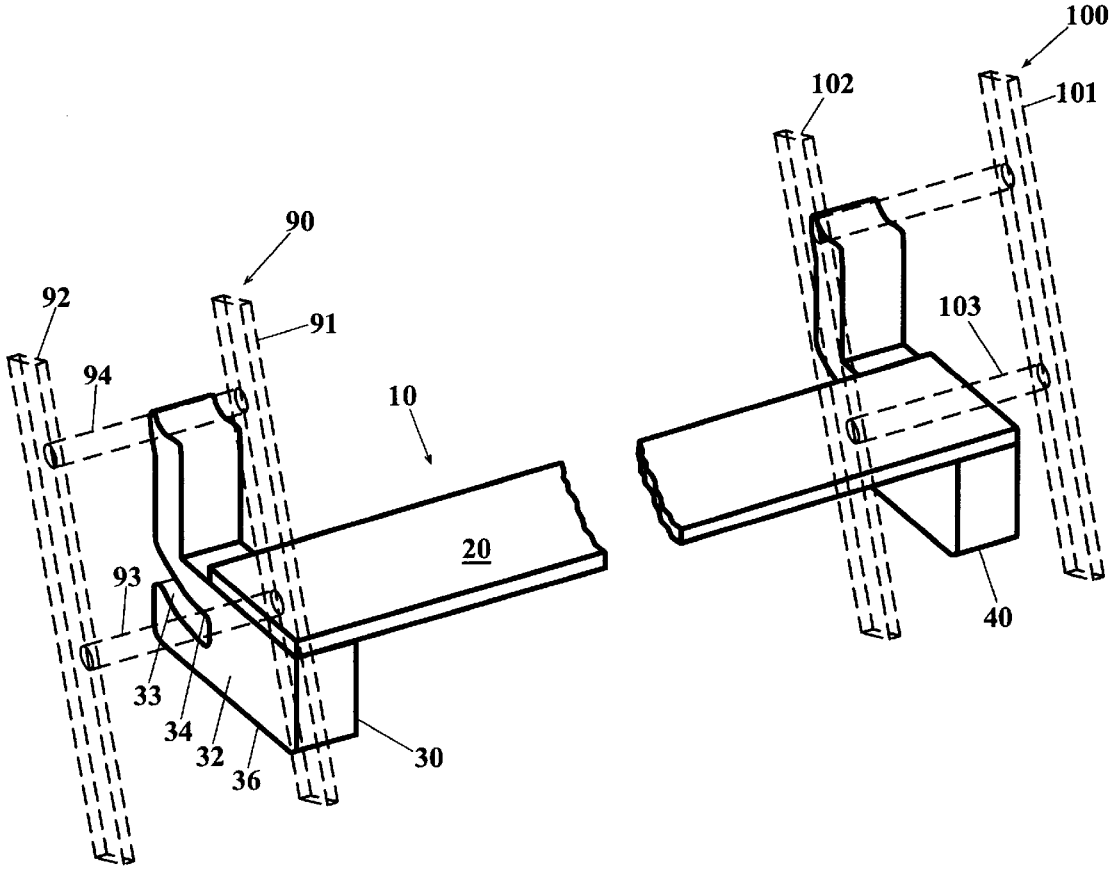

U.S. PATENT DOCUMENTS 4,306,700 12/1981 Bell .
4,437,544 3/1984 Anderson et al. .
4,901,818 2/1990 Schmitt .
4,911,265 3/1990 Skaggs .
4,941,547 7/1990 Livick .
4,972,923 11/1990 Kranse .
5,031,722 7/1991 Renand .
5,056,620 10/1991 Zumwalt et al. .
5,460,241 10/1995 LaBelle .

LADDER SUPPORTED SCAFFOLDING

The present application is related to application Ser. No. 08/731,442 filed Oct. 15, 1996, entitled "Ladder Supported Holding Tray". This application is also related to copending application Ser. No. 08/757,755 filed Nov. 26, 1996, U.S. Pat. No. 5,842,253, issued Dec. 1, 1998, entitled "Ladder Supported Holding Tray for a Paint Roller". This application is also related to application Ser. No. 08/768,864 filed Dec. 17, 1996, entitled "Ladder Supported Holding Tray Which Extends Outwardly from a Ladder". This application is also related to application Ser. No. 08/819,438 filed Mar. 17, 1997, concurrently herewith, now abandoned, entitled "Ladder Supported Platform". All aforementioned copending applications are by the same inventors as the present application. These applications are incorporated herein by this reference.

BACKGROUND

Painting or other work performed on the interior or exterior of a building at an elevated position typically involves working from a ladder which can be both uncomfortable or unsafe, or from commercial scaffolding which is expensive to own or rent and is very time consuming to construct. Ladder scaffolding is a common inexpensive solution for workers doing painting or small repair jobs on the exterior or interior of buildings. Typically, ladder scaffolding consists of two ladders that support a scaffold plank through the employment of ladder jacks or scaffold brackets. Although ladder scaffolding is inexpensive to own or rent and requires a short time to erect compared to standard commercial scaffolding, there have been inherent problems with systems of this type.

A first problem inherent with ladder scaffold designs using scaffold brackets or ladder jacks has been the necessity to make the scaffold brackets or ladder jacks highly adjustable to accommodate various ladders designs, as well as different ladder angles, and different sizes of scaffold planks. Scaffold brackets and ladder jacks that offer adjustment in these areas are often unnecessarily complex and require long set up times. The scaffold brackets and ladder jacks that do not provide these adjustment are often incapable of properly maintaining the proper positioning of a scaffold plank and the safe securement of the plank.

The requirement of the user to make many adjustments on a ladder scaffold system increases the potential that an adjustment will be improperly performed or accidentally omitted. There is a corresponding safety risk with a complex system of this type as well as a necessity for adequate training of employees to insure proper assemblies. Scaffold designs of this type that merely use a scaffold plank supported on brackets or ladder jacks have an inherent instability and obviously require that the system be assembled properly.

Ad additional safety risk associated with ladder scaffold systems is derived from the location of the scaffold plank in relation to the ladder. Existing ladder scaffold brackets and ladder jacks position the scaffold plank either in front of the ladder or behind the ladder. In either location, stepping from the ladder onto the scaffold plank requires the user to move forward or backward, as well as laterally onto the plank. The difficulty of this move is exaggerated when the user is carrying tools or hardware. Any ladder scaffold system that places the scaffold plank in front of the ladder additionally requires the user to somehow climb above the scaffold plank that is blocking the ladder and then step onto it. There is an inherent danger in moves of this type on a ladder, even at low elevations. Additionally, ladder scaffold systems of this type restrict work from being done from the ladder at the same time as the scaffold is being used.

A ladder scaffold system is far less time consuming to erect than a commercial scaffold system. However, compared to working off of ladder, ladder scaffold systems require a much higher set up time. Due to the complexity of many ladder scaffold systems a great deal of inefficiency is added to repair work or painting. This inefficiency is most evident for workers having to reposition the scaffold on the ladder at different elevations or for workers having to move the entire system even short distances. The worker faced with the extra time commitment of assembling a ladder scaffold system will often forgo the use of the scaffold system and instead work from the extension ladder. This decision may cause the worker to perform a task in an unsafe manner such as reaching excessively from the ladder.

Existing ladder scaffold systems that utilize multiple pieces require users of these systems to monitor the whereabouts of all the various components of the system in addition to monitoring ladders and scaffold planks. This requirement can be difficult in work environments that are large or cluttered and adds inefficiency to the use of ladder scaffold systems.

For the foregoing reasons there is a need for a ladder scaffold system that is quickly and easily assembled and eliminates complex adjustments. There is additionally a need for a ladder scaffold system that has a minimum of parts to assemble, monitor, and maintain. There is a need for a ladder scaffold system that is easy and safe to use, that does not require acrobatics to access from a ladder, and additionally does not interfere with the use of the ladder once assembled. There is also a need for a ladder scaffold system to be inexpensively manufactured from high strength materials.

SUMMARY

The ladder supported platform assembly of the present invention satisfies all of the aforementioned needs for a ladder scaffold assembly.

The ladder scaffold assembly of the present invention for releasable mounting on two spaced apart ladders placed side by side comprises a scaffold platform having opposing first and second lateral ends and a ladder attachment bracket disposed on the opposing ends of the platform for supporting the platform in an elevated horizontal position intermediate two spaced apart ladders. Step engagement means are disposed on each ladder attachment bracket, wherein the step engagement means comprise an upward sloping surface to releasably engage and securely hook onto a step from underneath the step. The step engagement means is rigidly attached to the ladder attachment bracket and is incapable of independent movement in relation to the platform. The upward sloping surface permits releasable engagement to a step that may comprise a step of a step ladder or adjacent side by side rungs of an extension ladder.

The ladder scaffold assembly may additionally comprise step contact means disposed on the ladder attachment bracket to permit temporary contact to a second step of a ladder located above the first step. The step contact means permits temporary contact with a second step that may comprise a step of a step ladder or rung of an extension ladder. The inclusion of the step contact means in the ladder attachment bracket allows for releasable mounting of the ladder scaffold on two spaced apart ladders placed side by side in an additional situation wherein the step engagement means releasably engages a single rung of an extension ladder. The step contact means are rigidly attached to the ladder attachment brackets and are incapable of independent movement in relation to the platform. The step contact means further may include tabs disposed on the top of the step contact means for contacting the bottom surface only of a second step.

The ladder attachment brackets extend laterally outwardly from the opposing ends of the lateral ends of the platform. The ladder attachment brackets may be independent and separable from the scaffold platform. Or, the ladder attachment brackets may be integrally formed with the scaffold platform.

The scaffold platform when mounted on a ladder extends laterally outwardly from the ladder so as to not interfere with the normal use of the ladder. The width of the ladder attachment bracket is approximately 10 to 30 percent of the length of a typical step. The ladder attachment bracket once attached to a step utilizes a small portion of the step that is immediately adjacent to the ladder rail and does not interfere with the normal use of the ladder. The ladder attachment bracket is typically substantially beneath the scaffold platform.

The upward sloping surface is typically concave. The upward sloping surface of the step engagement means originate at a position on the ladder attachment bracket proximate to the middle of the bracket and extend rearwardly therefrom to a position proximate to the back of the bracket. The step engagement means further comprises a convex surface and a step receiving recess defined by the gap between the convex surface and the concave upward sloping surface, and wherein the gap is larger than the thickness of a step which is received into the recess for securely positioning the platform on that step.

In a first version of the present invention, the ladder scaffold assembly for releasable mounting on two spaced apart ladders placed side by side comprises a scaffold platform having opposing first and second lateral ends and a ladder attachment bracket disposed on the opposing ends of the platform for supporting the platform in an elevated horizontal position intermediate two spaced apart ladders. Step engagement means are disposed on each ladder attachment bracket for engaging a single step of a ladder. The step engagement means permit secure temporary engagement of the scaffold assembly to two spaced apart ladders placed side by side without the need for additional support members, fasteners, or any moveable or adjustable parts capable of independent movement in relation to the scaffold platform, and without the scaffold assembly engaging the side rail members of the ladders or other steps of the ladder. The step engagement means permits releasable engagement to a step that may comprise a step of a step ladder or adjacent side by side rungs of an extension ladder.

In a second version of the present invention the ladder scaffold assembly for releasable mounting on two spaced apart ladders placed side by side comprises a scaffold platform having opposing first and second lateral ends and a ladder attachment bracket disposed on the opposing ends of the platform for supporting the platform in an elevated horizontal position intermediate two spaced apart ladders. Step engagement means are disposed on each ladder attachment bracket for engaging a first step of a ladder. Step contact means are disposed on each ladder attachment bracket for engaging a second step of a ladder located above the first step of the ladder; and wherein the step contact means contacts the bottom surface only of a second step of a ladder. The step engagement means and step contact means permit secure temporary engagement of the scaffold assembly to two spaced apart ladders placed side by side without the need for additional support members, fasteners, or any moveable or adjustable parts capable of independent movement in relation to the scaffold platform, and without the scaffold assembly engaging the side rail members of the ladders or other steps of the ladder. The first step engagement means permits releasable engagement to a step that may comprise a step of a step ladder, a single rung of an extension ladder, or adjacent side by side rungs of an extension ladder.

The ladder scaffold assembly of the present invention includes new features providing benefits heretofore unrealized by prior art ladder scaffolding designs.

A first benefit of the ladder scaffolding of the present invention is the ability of the ladder scaffolding to be easily and securely mounted and dismounted to different types of ladders including: step ladders, extension ladders in an extended condition, and extension ladders in a non-extended condition when the ladder sections are overlapping. The ladder scaffolding is able to be easily and securely mounted and dismounted from these many types and arrangements of ladders without any adjustment required to the scaffolding. The ladder scaffolding additionally does not require fasteners or additional supports to achieve this adaptability. Nor does the ladder scaffolding contact the side rails of the ladder to which it is mounted.

The efficiency and ease in which the ladder scaffolding mounts and dismounts from a ladder insures a minimum of lost time and a high degree of safety for the worker using the scaffolding. Workers currently faced with the long set up times required by existing ladder scaffold designs will not hesitate to utilize the benefits offered by the simplicity of the ladder scaffolding of the present invention. As such, workers would be much less likely to take the unnecessary safety risk of not using the ladder scaffolding while working on a ladder. The ladder scaffolding can be safely and easily mounted and dismounted from a ladder by a single person. As no adjustments are required to assemble and mount the scaffolding, no mistakes can be made during this process. Once mounted, the scaffolding is also very easily accessed from the ladder making the scaffolding much safer than existing ladder scaffolding design.

The ladder scaffolding utilizes step engagement means that include an upward sloping surface that is typically concave that allows the scaffolding to hook under and lock itself onto steps or rungs to which it is engaged. Once engaged, the upward sloping surface of the step engagement means prevent a lateral force from moving the scaffolding in relation to the ladder. The scaffolding is resistant to upward and downward forces, as well. Nevertheless, the scaffolding is easily removed from a step or set of rungs. To release the scaffolding from the ladder, the user must only tilt the scaffolding slightly while moving the scaffolding away from the ladder.

The ladder scaffolding offers the additional benefits of being light in weight while maintaining a high strength. The ladder scaffolding can be produced using inexpensive high strength plastics or aluminum if higher durability is required. Low cost manufacturing techniques such as molding or stamping could be utilized in the production of the scaffolding. These and other advantages of the present invention will become apparent upon inspection of the accompanying specification, claims and drawings.

DRAWINGS

FIG. 1 shows a first version of the ladder scaffold assembly attached to two spaced apart extension ladders placed side by side. The extension ladders are shown in an extended condition.

Figure 1A:
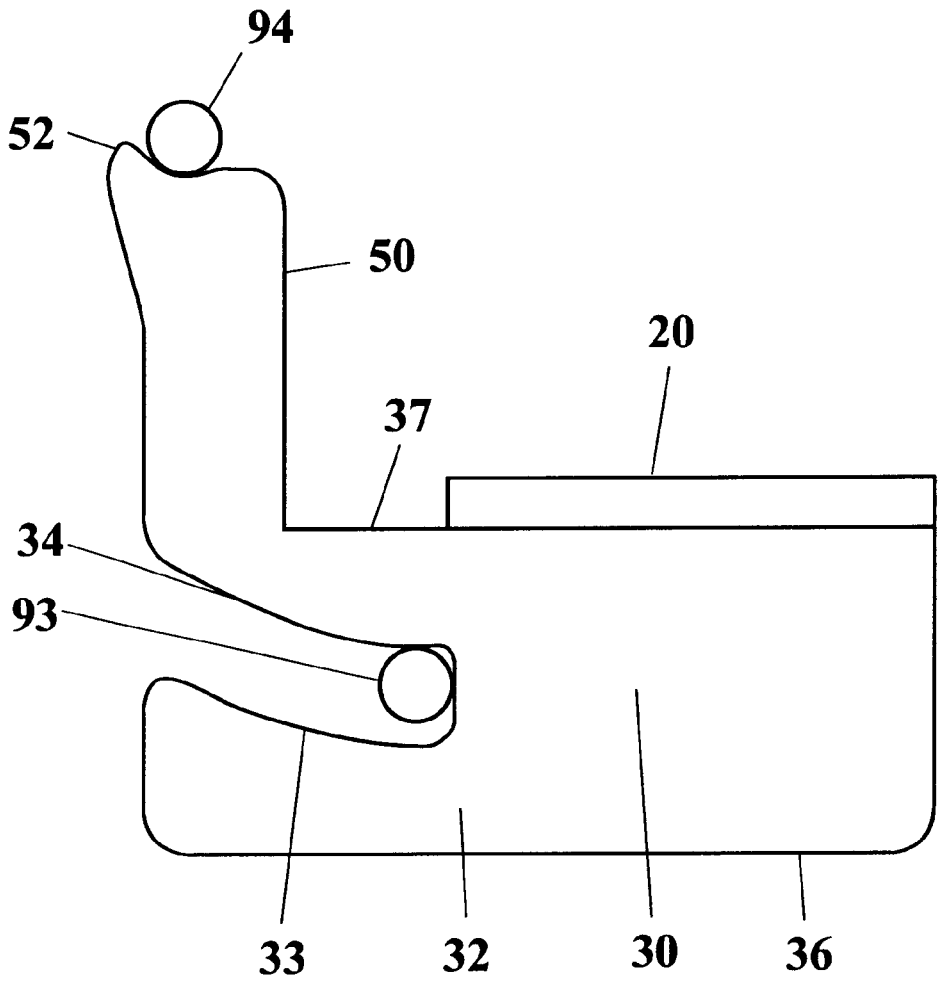

FIG. 1*a* shows a side profile of the ladder attachment bracket attached to the single rungs of an extension ladder in an extended condition.

Figure 2:
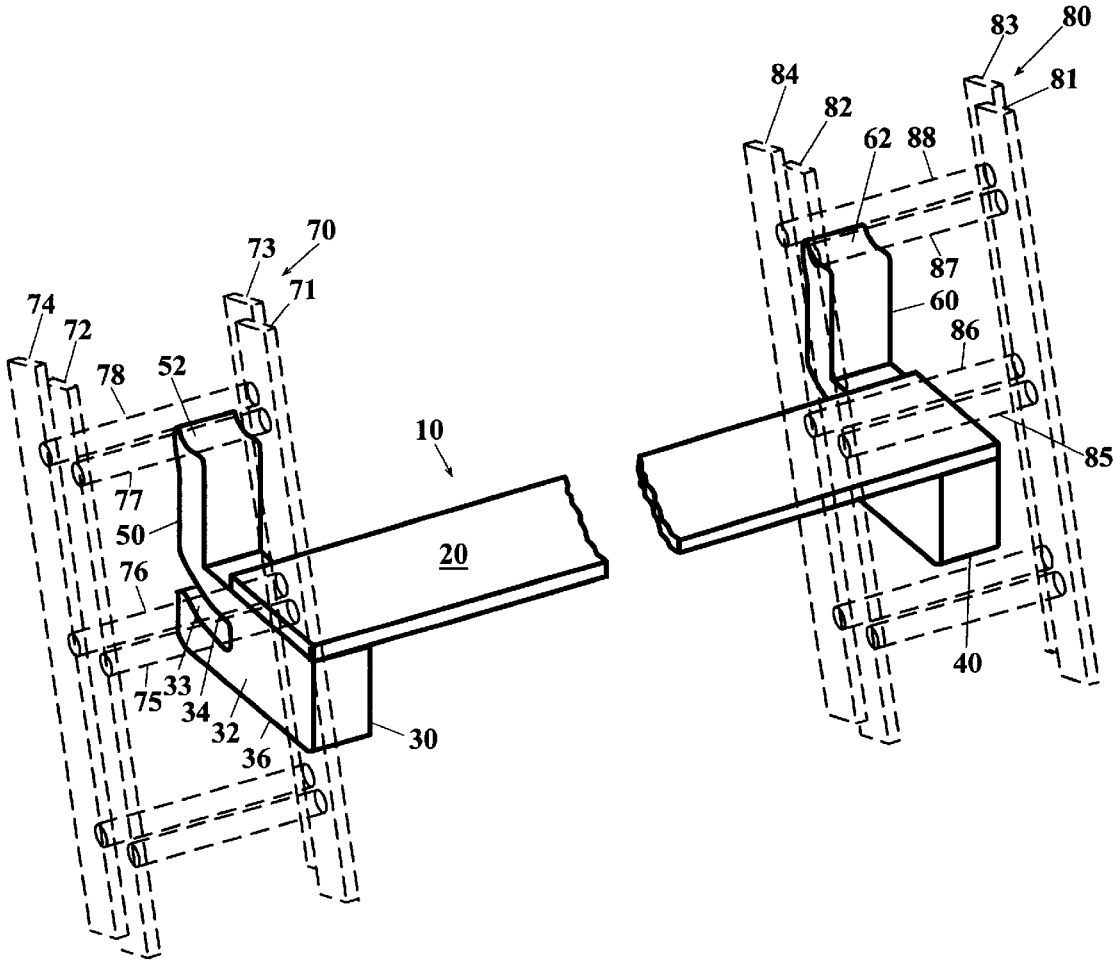

FIG. 2 shows the first version of the ladder scaffold assembly attached to two spaced apart extension ladders placed side by side. The extension ladders are shown in a non-extended condition.

Figure 2A:
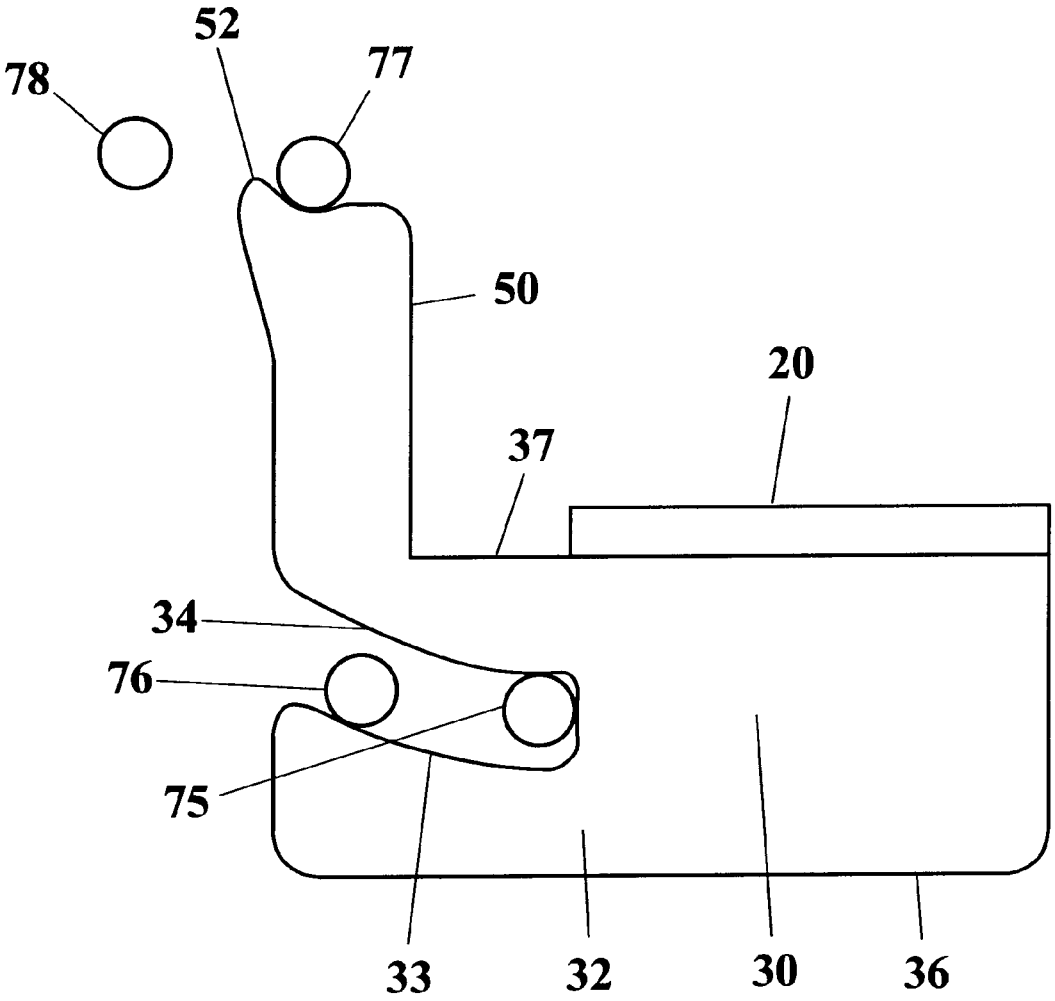

FIG. 2*a* shows a side profile of the ladder attachment bracket attached to the adjacent side by side rungs of overlapping sections of an extension ladder in a non-extended condition.

Figure 2B:
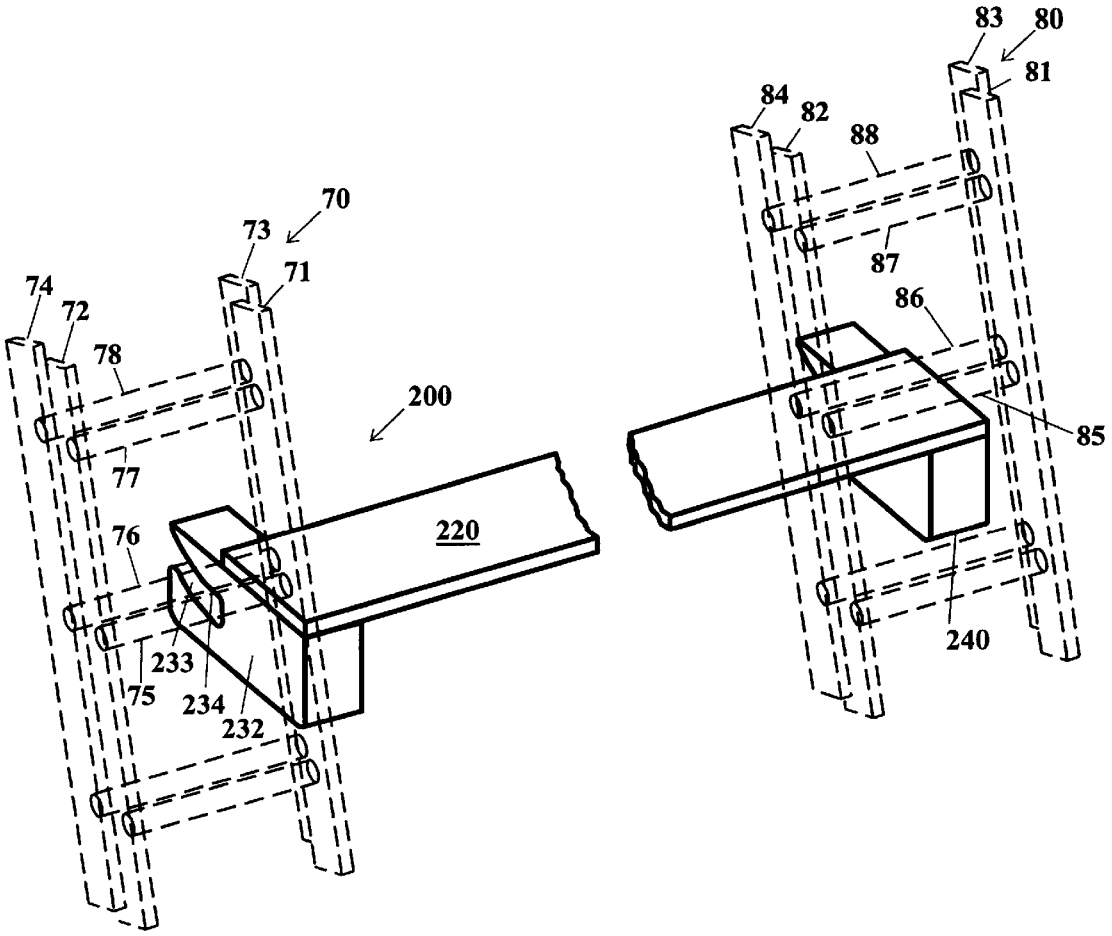

FIG. 2*b* shows a second version of the ladder scaffold assembly attached to two spaced apart extension ladders placed side by side. The extension ladders are shown in a non-extended condition.

Figure 3:
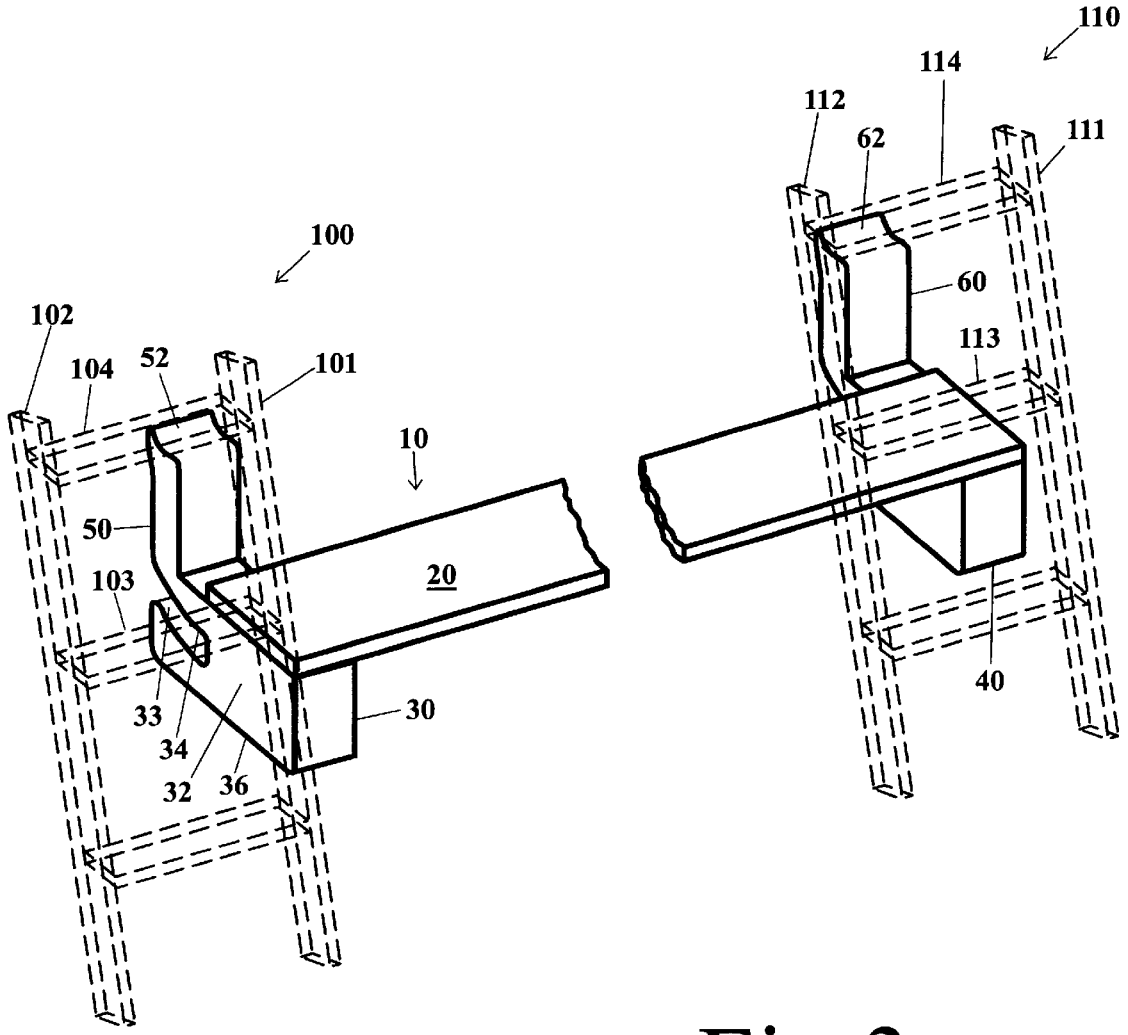

FIG. 3 shows the first version of the ladder scaffold assembly of the present invention attached to the front portion of two spaced apart step ladders.

Figure 3A:
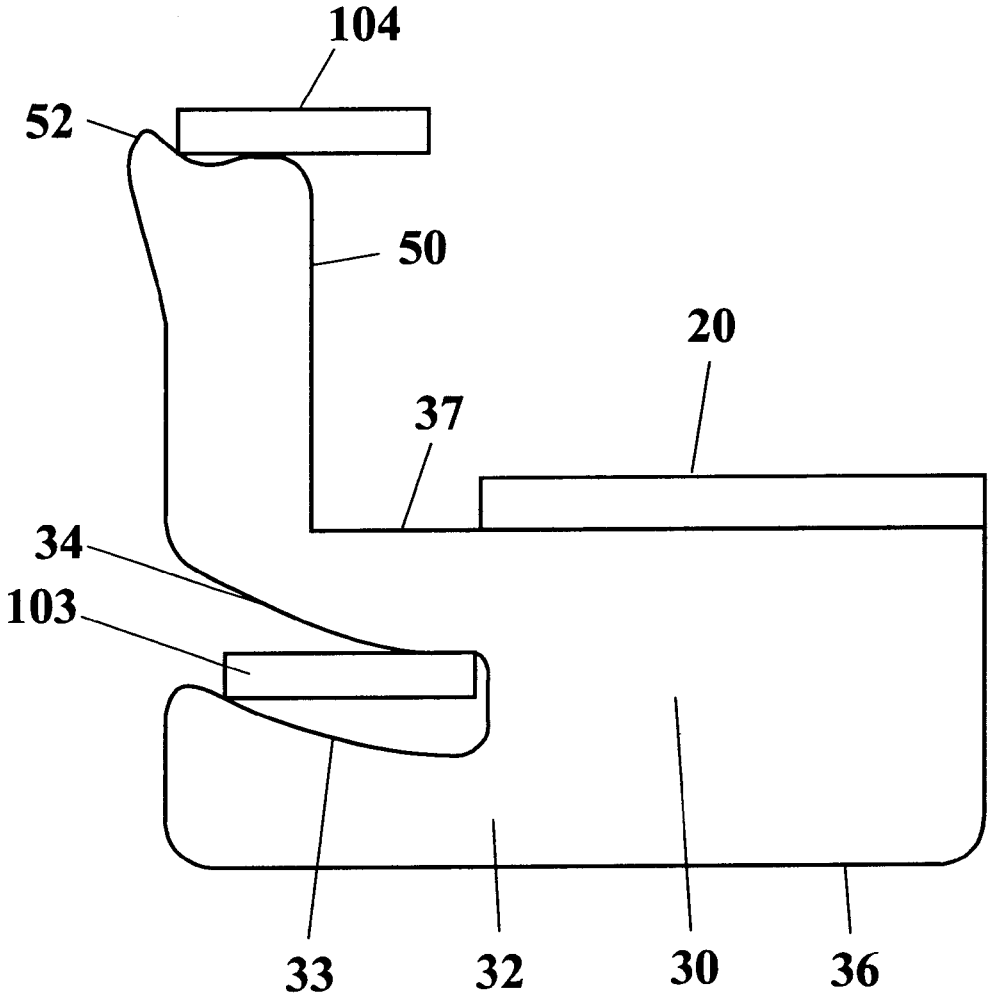

FIG. 3*a* shows a side profile of the ladder attachment bracket attached to steps of a step ladder.

Figure 3B:
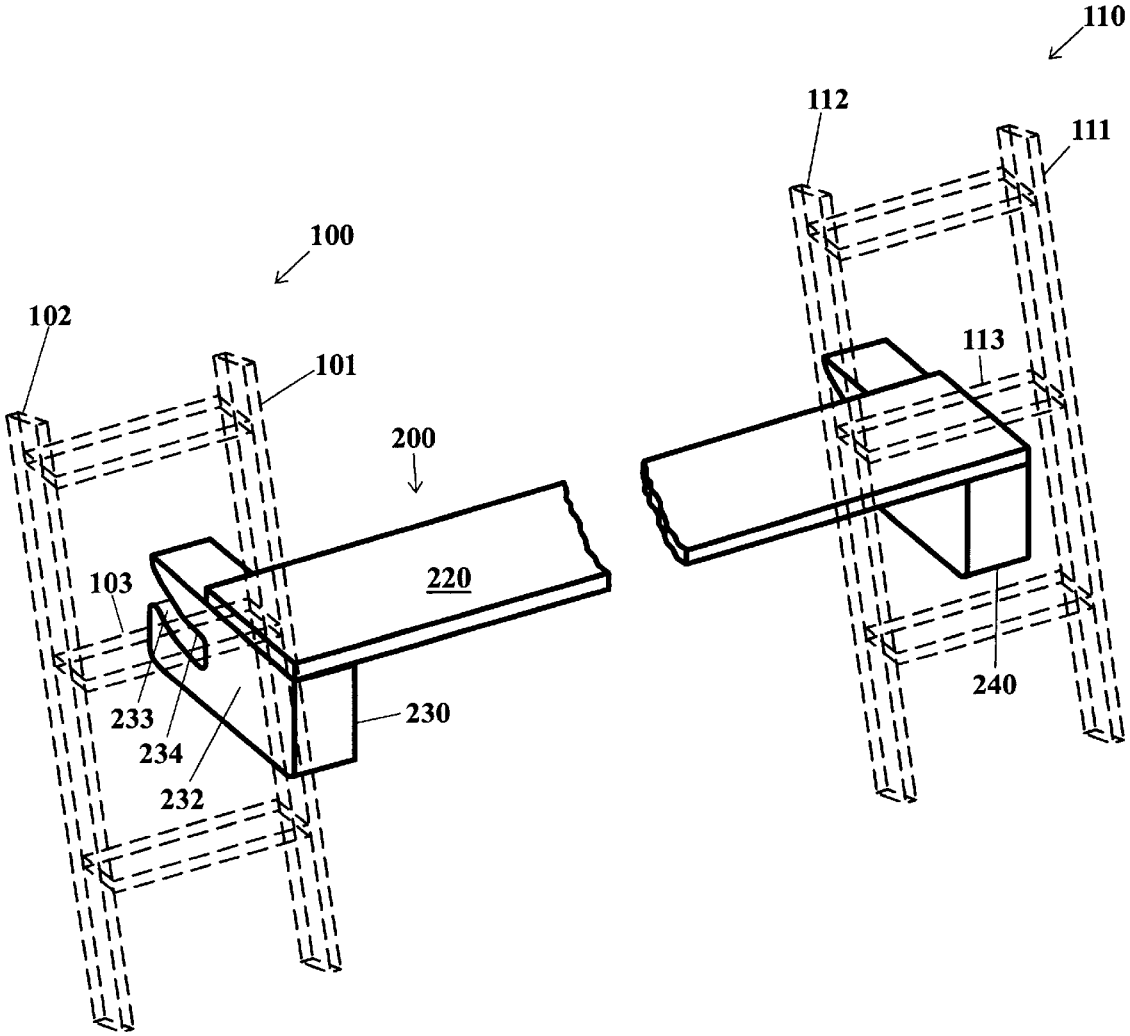

FIG. 3*b* shows the second version of the ladder scaffold assembly attached to two spaced apart step ladders placed side by side.

Figure 4:
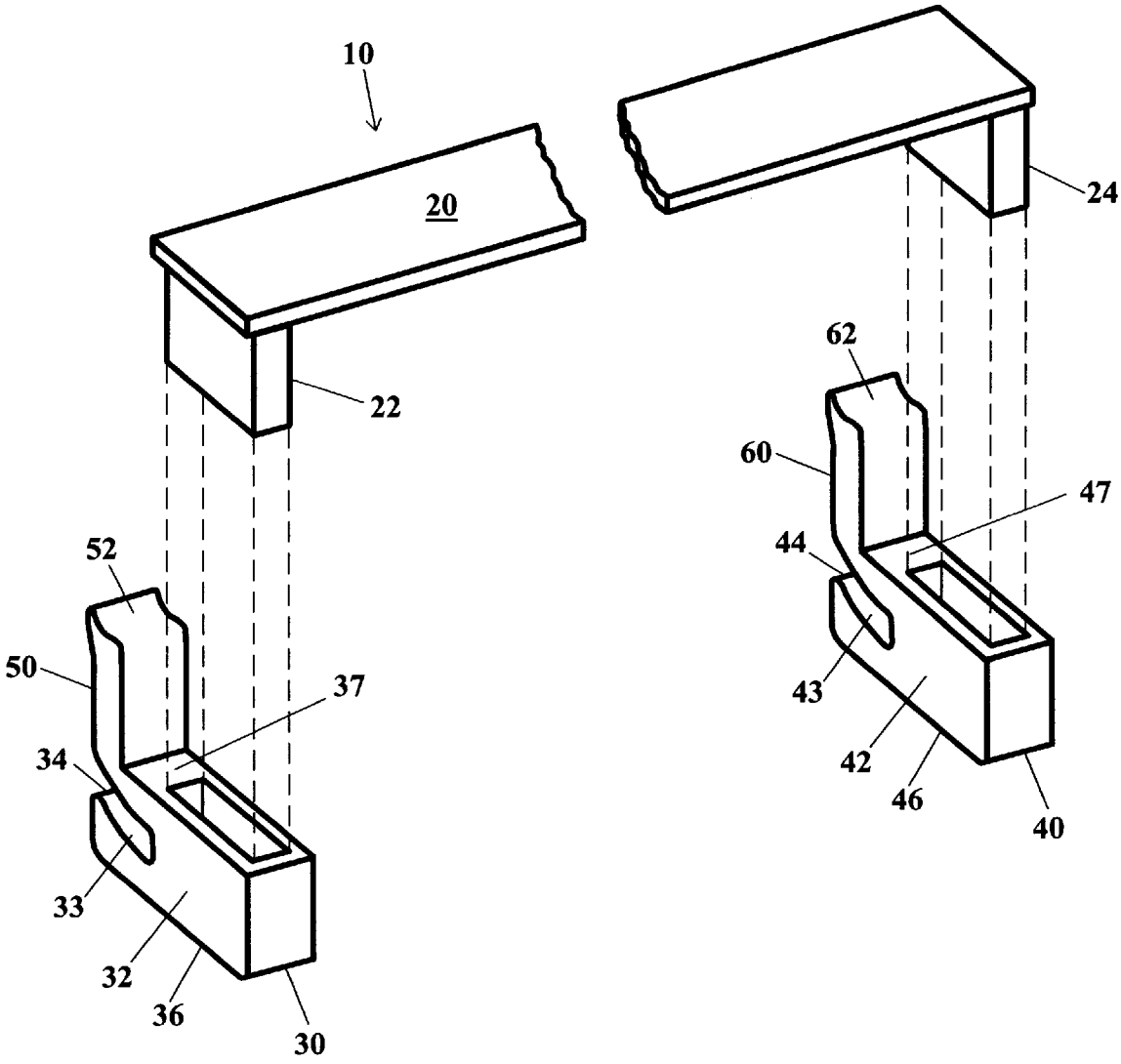

FIG. 4 shows the ladder scaffold assembly in an exploded view.

DESCRIPTION

Referring to the drawings, FIG. 1 shows a first version of the ladder scaffold assembly 10 attached to two spaced apart extension ladders 90 and 100 placed side by side. The extension ladders 90 and 100 are shown in an extended condition. The ladder scaffold assembly includes a platform 20, a first ladder attachment bracket 30, and a second ladder attachment bracket 40. Ladder attachment brackets 30 and 40 are disposed at the opposing ends of the platform 20 and support the platform in an elevated horizontal position between the two spaced apart ladders 90 and 100. FIG. 1*a* shows a side profile of the of the ladder attachment bracket 30 attached to rungs 93 and 94 of extension ladder 90.

FIG. 2 shows the first version of the ladder scaffold assembly 10 attached to two spaced apart extension ladders 70 and 80 placed side by side. The extension ladders 70 and 80 are shown in a non-extended condition. FIG. 2*a* shows a side profile of the ladder attachment bracket 30 attached to adjacent side by side rungs 75 and 76, as well as 77 and 78 of overlapping sections of extension ladder 70 in a non-extended condition. FIG. 2*b* shows a second version of the ladder scaffold assembly 200 of the present invention attached to two spaced apart extension ladders 70 and 80 placed side by side. Ladder attachment brackets 230 and 240 do not include extensions that comprise step contact means.

FIG. 3 shows the first version of the ladder scaffold assembly 10 attached to the front portion of two spaced apart step ladders 100 and 110. FIG. 3*a* shows a side profile of the ladder attachment bracket 30 attached to steps 103 and 104 of a step ladder.

FIG. 4 shows the ladder scaffold assembly in an exploded view. This figure shows the interconnection of the scaffold platform 20 with the ladder attachment brackets 30 and 40 in the version of the present invention when the ladder attachment brackets are independent and separable from the scaffold platform.

In greater detail, FIG. 1 shows a first version of the ladder scaffold assembly 10 attached to two spaced apart extension ladders 90 and 100 placed side by side. Extension ladder 90 includes side rails 91 and 92 supporting rungs 93 and 94. Extension ladder 100 includes side rails 101 and 102 supporting rungs 103 and 104. Both extension ladders 90 and 100 are shown in an extended condition. Ladder scaffold assembly 10 includes a scaffold platform 20 and ladder attachment brackets 30 and 40 disposed on the opposing lateral ends of the platform. The ladder attachment brackets may be disposed such that the ladder attachment brackets are independent and separable from the scaffold platform or alternatively in an arrangement when the ladder attachment brackets and the scaffold platform are integrally formed and manufactured. In either case, the ladder attachment brackets extend laterally outwardly from the opposing lateral ends of the scaffold platform.

FIG. 1 further shows the relationship of ladder attachment brackets 30 and 40 to ladders 90 and 100. Ladder attachment brackets 30 and 40 are shown having a width that is approximately 30 percent of the length of the rungs used on ladders 90 and 100. This width allows the full length of a ladder to be used while the ladder scaffold assembly 10 is in attachment to the ladders. The scaffold assembly as shown in FIG. 1 is attached to ladders 90 and 100 so that the scaffold platform extends laterally outwardly from the ladder so as to not interfere with the normal use of the ladder. The width of the ladder attachment brackets may vary between 10 and 30 percent of standard rung lengths depending on the length of the scaffold platform supported and the strength of the materials used in the construction of the ladder attachment brackets.

FIG. 1*a* shows the details of the construction of the ladder attachment bracket 30 as well as the details of the engagement of the ladder attachment brackets to rungs 93 and 94 of the ladder 90. As shown in this figure, the ladder attachment bracket 30 includes step engagement means 32 that includes a concave upward sloping surface 33, a convex surface 34, and a step receiving recess defined by the gap between the convex surface 34 and the concave upward sloping surface 33. The gap defining the step receiving recess is larger than the thickness of any step which is received into this recess which in this figure is rung 93. The step engagement means 32 including concave upward sloping surface 33 is rigidly attached to the ladder attachment bracket 30 and is incapable of independent movement in relation to the ladder attachment bracket. The upward sloping surface of the step engagement means originates at a position on the ladder attachment bracket proximate to the middle of the ladder attachment bracket and extends rearwardly to a position proximate to the back of the platform.

Also shown in FIG. 1*a* is step contact means 50 disposed at the back of the ladder attachment bracket 30. Step contact means includes tab 52 disposed at the top of the step contact means 50 which is contacting the bottom surface of rung 94. Step contact means 50 is disposed on the ladder attachment bracket to permit temporary contact with a second step (in this case rung 94) of a ladder located above the first step. The step contact means 50 is rigidly attached to the ladder attachment bracket and is also incapable of independent movement. It is the inclusion of step contact means 50 that allows the releasable attachment of the ladder scaffold assembly to an extension ladder in an extended condition as is shown in FIG. 1 and 1*a*. The ladder attachment bracket (along with the scaffold platform) is weighted to rotate forwardly about the ladder until the tab contacts the bottom surface of rung 94. At this point the ladder scaffold assembly is secured to the ladder 90 and is useable on the ladder.

Ladder attachment bracket 40 is typically identical to ladder attachment bracket 30. Ladder attachment brackets 30 and 40 include top surfaces 37 and 47 respectively which provide a supporting surface for the scaffold platform. The attachment brackets also typically include a flat bottom shown at 36 on the ladder attachment bracket 30 to support the scaffold assembly on a flat surface.

FIG. 2 shows the ladder scaffold assembly 10 attached to two spaced apart extension ladders 70 and 80 placed side by side. The extension ladders 70 and 80 are each shown in a non-extended condition. Ladder 70 includes a first section including side rails 71 and 72 which support rungs 75 and 77, and a second section including side rails 73 and 74 supporting rungs 76 and 78. Similarly, extension ladder 80 includes a first section including side rails 81 and 82 supporting rungs 85 and 87, and a second section including side rails 83 and 84 supporting rungs 86 and 88. The first sections of both ladders are shown overlapping the second sections so that rungs 75 and 76, as well as 77 and 78 are both adjacent and side by side, thus creating a single step between each set of two rungs.

FIG. 2*a* shows the engagement of the ladder attachment bracket to adjacent side by side rungs 75 and 76 as well as 77 and 78. The concave upward sloping surface 33 of step engagement means 32 releasably engages and hooks onto rungs 75 and 76 from underneath the rungs. Additionally the tab 52 of step contact means 50 contacts the bottom surface of rung 77. The ladder attachment bracket 40 is similarly releasably engaged to rungs 85, 86, and 87. It will be shown in FIG. 2*b* that the step contact means 52 and 62 are not necessary if the step contact means engage adjacent side by side rungs of an extension ladder. Nevertheless, step contact means 50 and 60 do provide an additional degree of security for the retention of ladder attachment brackets on ladders even when the step contact means are not immediately required.

FIG. 2*b* shows a second version of the ladder scaffold assembly 200 where the step contact means have been removed from the ladder scaffold brackets. As was previously mentioned, step contact means 32 are sufficient to retain the ladder scaffold assembly on a ladder when the ladder includes adjacent side by side rungs. FIG. 2*b* shows the ladder scaffold assembly 200 attached to two spaced apart extension ladders 70 and 80 placed side by side. Step engagement means 32 including upward sloping concave surface 233 and convex surface 234 engage rungs 75 and 76 in an identical manner as was described for the step engagement means 32 of the first version shown in FIGS. 2 and 2*a*.

FIGS. 3, 3*a*, and 3*b* show the attachment of the first and second versions of the present invention to the front sections of two spaced apart step ladders 100 and 110 placed side by side. The engagement of step engagement means 32 and step contact means 50 to steps of a step ladder is very similar to the engagement to adjacent side by side rungs as was previously described. FIG. 3*a* shows the attachment of the ladder attachment bracket 30 to steps 103 and 104 of step ladder 100. In this figure the upward sloping surface 33 of the step engagement means 32 releasably engages and securely hooks onto step 103 from underneath the step. Tab 52 of step contact means 50 contacts the bottom of step 104. As was the case for adjacent side by side rungs the ladder attachment brackets would have been sufficiently secured to ladders 100 and 110 without the step contact means 50 and 60. Nevertheless, step contact means 50 and 60 do add an additional degree of security to the ladder scaffold assembly. FIG. 3*b* shows the removal of step contact means from ladder attachment brackets 230 and 240 in the second version of the ladder scaffold assembly 200.

FIG. 4 shows the ladder scaffold assembly in an exploded view. This figure shows interconnection of the scaffold platform 20 with the ladder attachment brackets 30 and 40 in the version of the present invention when the ladder attachment brackets are independent and separable from the scaffold platform. FIG. 4 shows a tenon and mortise joint connecting the scaffold platform 20 to ladder attachment brackets 30 and 40. In this arrangement tenons 22 and 24 are retained within mortises 35 and 45 disposed within ladder attachment brackets 30 and 40.

Using the ladder scaffold assembly is simple. Once the user determines the location on the ladder where the scaffold will be attached, the user needs only to slide the rung, set of rungs, or step into the step receiving recess separating the concave upward sloping surface from the convex surface. To slide the ladder attachment bracket onto a rung, set of rungs, or step, the user needs only to slightly tilt the attachment bracket so that the leading edge of the step engagement means will pass under the step. At the same time, the user moves the attachment bracket toward the ladder until the rung, set of rungs, or step are as far into the step receiving recess as possible. At this point, the step engagement means has hooked under the rung, set of rungs, or step. The user then allows the weight of the attachment bracket to rotate the attachment bracket slightly forward in relation to the step. The rotation will continue until the concave upward sloping surface of the step engagement means contacts the step, rung, or side by side set of rungs. If the ladder scaffold assembly is being attached to a single rung of a ladder the step contact means will engage a next higher rung of the ladder which will stop the forward rotation of the attachment bracket and secure the attachment bracket on a ladder. The step contact means will also contact the next higher step or rung when the platform is engaged to an extension ladder in a non-extended condition or to a step ladder adding a further degree of security. The second version of the invention the step contact means have been removed for engagement with extension ladders in a non-extended condition and step ladders only.

Once the attachment bracket has slightly rotated forward and the concave upward sloping surface is in contact with the rung, set of rungs, or step, the attachment bracket is securely attached to the ladder and the user can release the attachment bracket. Neither the attachment brackets nor the scaffold platform contact the ladder rails. Because of this the ladder scaffold system accommodates the great variances in the ladder rails of existing ladders.

At no time during the attachment of the attachment bracket to the ladder does the user have to reposition his or her hand on the attachment bracket. Additionally, the other hand of the user is not required for mounting the platform, so the user can maintain a firm hand hold on the ladder. Once both attachment brackets are secured to the two spaced apart ladders placed side be side the user mounts the scaffold platform on the attachment brackets. In the version of the present invention where the ladder attachment brackets and scaffold platform are integral the user must mount both attachment brackets simultaneously on the two ladders being used.

Releasing the attachment brackets from the step, rung, or set of rungs, is as easy as securing the tray to a step, rung, or set of rungs. The user needs only to grab the attachment brackets and then pull the attachment brackets away from the ladder while slightly tilting the attachment brackets to release the step engagement means from the step, rung, or set of rungs.

Once secured to a ladder the ladder scaffold assembly is extremely stable. The scaffold assembly is essentially locked on to the ladder and resists all movement in relation to the ladder. There is little chance of accidentally knocking the scaffold assembly off the ladder as releasing the attachment brackets from the ladder requires the attachment brackets to be simultaneously tilted slightly and moved away from the ladder. The scaffold assembly also resists side to side movement well and resists upward or downward movement as the step engagement means straddles above and below the step. Supporting people, tools, or building materials on the scaffold platform once the scaffold assembly is secured to two ladders is easy due to the stability of the scaffold assembly. The scaffold assembly does not interfere with the use of the ladders once attached and is very easily accessed from a ladder. A user can ascend to the necessary height on the ladder and then safely move laterally onto the scaffold platform.

The ladder scaffold assembly is easily manufactured using existing plastic molding techniques. The scaffold assembly could be produced as a single piece or as multiple pieces that require a small degree of assembly. The ladder scaffold assembly could be manufactured in a variety of sizes or shapes. Alternative designs of the ladder scaffold assembly may include modifications to the scaffold platform that would benefit the security of people or items placed on the platform. These modifications could include elements such as hand rails attached to the scaffold platform. The ladder scaffold assembly could also include a carrying handles. The ladder scaffold assembly could also be utilized by a supporting structure other than two spaced apart ladders placed side by side.

Although preferred versions of the ladder scaffold assembly of the present invention are shown in FIGS. 1 to 4, it is also understood that various modifications and changes in form or detail could readily be made without departing from the spirit of the invention. It is therefore intended that the invention be not limited to the exact form and detail herein shown and described, nor to anything less than the whole of the invention herein disclosed and as hereinafter claimed.

What is claimed is:

1. In combination, first and second step ladders and a scaffolding assembly for releasable attachment to the step ladders comprising:

first and second step ladders; wherein each step ladder includes opposing side rails, a ladder top panel disposed between the opposing side rails, and a plurality of steps disposed between the opposing side rails at positions beneath the ladder top panel; wherein each step includes a flat top surface having a front and back edge, a front side comprising a surface attached to the flat top front edge and extending downwardly therefrom, a back side comprising a surface attached to the flat top back edge and extending downwardly therefrom, and wherein the front side and the back side each include a bottom edge; and wherein each step includes a width defined by the distance from the front side to the back side; and, wherein the area between the front side and the back side of each step is disposed in front of the back side of the step;

a scaffold assembly attached to the step ladder, the scaffold assembly comprising:

a scaffold platform having opposing first and second lateral ends;

first and second ladder attachment brackets; wherein the first ladder attachment bracket is disposed on the first end of the platform; and wherein the second ladder attachment bracket is disposed on the second end of the platform; and, wherein the first ladder attachment bracket is temporarily secured to the first ladder, and wherein the second ladder attachment bracket is temporarily secured to the second ladder; and wherein the ladder attachment brackets support the platform in an elevated horizontal position between the first and second step ladders; and wherein each ladder attachment bracket includes at least one step engagement means disposed on the ladder attachment bracket to permit secure temporary attachment of the ladder attachment bracket to the ladder through secure temporary engagement to a single selected step of the step ladder;

wherein the step engagement means comprises a first section disposed substantially in front of the front side of the selected step; a second section attached to the first section and extending rearwardly from the first section above the top surface of the selected step; the second section including a distal free end; the second section further having a length such that the second section at least partially extends above the top surface of the selected step; and a third section attached to the first section and extending rearwardly from the first section underneath the selected step; the third section including a distal free end; the third section further having a length longer than the width of the selected step, such that the distal free end of the third section is disposed at a position behind the back side of the selected step; wherein the third section further includes an upward sloping surface; wherein the upward sloping surface begins at a location in front of the bottom edge of the back side of the selected step and wherein the upward sloping surface engages the bottom of the back side of the selected step; wherein the distal free end of the third section does not contact the top of the selected step; and, wherein the distal free end of the third section does not contact the distal free end of the second section; and, wherein the upward sloping surface slopes upwardly in relation to the flat top of the selected step.

2. The combination of claim 1, wherein the upward sloping surface is also concave.

3. The combination of claim 1, wherein the ladder attachment brackets are independent and separable from the scaffold platform.

4. The combination of claim 1, wherein each ladder attachment bracket further includes means for contacting a second step; and wherein the means for contacting a second step is disposed above the step engagement means; and, wherein the means for contacting a second step contacts a second selected step disposed above the selected step on which the step engagement means is engaged.

5. In combination, first and second extension ladders having multiple sections and a scaffolding assembly for releasable attachment to the extension ladders comprising:

first and second extension ladders; the first and second extension ladders each having at least front and back sections; and wherein at least a portion of the front and back sections are in an overlapping orientation; each ladder section including opposing side rails and a plurality of substantially round rungs disposed between the opposing side rails; wherein each rung includes a top for foot support, a bottom, a front and a back; wherein the overlapping front and back sections of the ladder include a plurality of adjacent side by side pairs of front and back rungs; and wherein each pair of adjacent side by side rungs defines a single step having a width defined by the distance from the front of the front rung to the back of the back rung;

a scaffold assembly attached to the step ladder, the scaffold assembly comprising:

a scaffold platform having opposing first and second lateral ends;

first and second ladder attachment brackets; wherein the first ladder attachment bracket is disposed on the first end of the platform; and wherein the second ladder attachment bracket is disposed on the second end of the platform; and, wherein the first ladder attachment bracket is temporarily secured to the first ladder; and wherein the second ladder attachment bracket is temporarily secured to the second ladder, and wherein the ladder attachment brackets support the platform in an elevated horizontal position between the first and second extension ladders; and wherein each ladder attachment bracket includes at least one step engagement means disposed on the ladder attachment bracket to permit secure temporary attachment of the ladder attachment bracket to the ladder through secure temporary engagement to a single selected step of the extension ladder;

wherein the step engagement means comprises a first section disposed substantially in front of the front rung of the selected step; a second section attached to the first section and extending rearwardly from the first section above the selected step; the second section including a distal free end; the second section further having a length such that the second section at least partially extends above the front rung of the selected step; and a third section attached to the first section and extending rearwardly from the first section underneath the selected step; the third section including a distal free end; the third section further having a length longer than the width of the selected step, such that the distal free end of the third section is disposed at a position behind the back rung of the selected step; wherein the third section further includes an upward sloping surface; wherein the upward sloping surface begins at a location in front of the back rung of the selected step, and wherein the upward sloping surface engages the bottom of the back rung of the selected step; wherein the distal free end of the third section does not contact the top of the back rung of the selected step; and, wherein the distal free end of the third section does not contact the distal free end of the second section; and, wherein the upward sloping surface slopes upwardly in relation to a plane connecting the tops of the front and back rungs of the selected step.

6. The combination of claim 5, wherein the upward sloping surface is also concave.

7. The combination of claim 5, wherein the ladder attachment brackets are independent and separable from the scaffold platform.

8. The combination of claim 5, wherein each ladder attachment bracket further includes means for contacting a second step; and wherein the means for contacting a second step is disposed above the step engagement means; and, wherein the means for contacting a second step contacts a second selected step disposed above the selected step on which the step engagement means is engaged.

* * * * *